United States Patent [19]

May

[11] Patent Number: 5,027,557

[45] **Date of Patent: * Jul. 2, 1991**

[54] SOUND SILENCED WINDOW FRAME JAMB LINER SASH GUIDE POCKET

[75] Inventor: Michael M. May, Stillwater, Minn.

[73] Assignee: Intek Weatherseal Products, Inc., Hastings, Minn.

[ * ] Notice: The portion of the term of this patent subsequent to Apr. 10, 2007 has been disclaimed.

[21] Appl. No.: 400,519

[22] Filed: Aug. 30, 1989

[51] Int. Cl.[5] ..... E05D 15/22

[52] U.S. Cl. ..... 49/181; 49/446

[58] Field of Search ..... 49/176, 181, 445, 446, 49/453, 454, 450, 451, 422; 16/87 R, 197; 160/92; 292/23, 193, 257, 341.12, DIG. 7, DIG. 17, DIG. 20, DIG. 47, DIG. 73

[56] References Cited

U.S. PATENT DOCUMENTS

| | | | |
|---|---|---|---|
| 2,742,666 | 4/1956 | Blair | 16/197 |
| 2,778,069 | 1/1957 | Starck et al. | 49/422 |
| 2,786,230 | 3/1957 | Hettinger | 16/197 |
| 2,848,760 | 8/1958 | Hettinger et al. | 16/197 X |
| 2,879,559 | 3/1959 | Lundgren | 16/197 X |
| 2,939,170 | 6/1960 | Lundgren | 16/197 |
| 2,986,771 | 6/1961 | Martin | 16/197 |
| 3,114,178 | 12/1963 | Wood | 49/446 |
| 3,157,917 | 11/1964 | Peters | 49/181 |
| 3,290,825 | 12/1966 | Adams | 49/431 |
| 3,399,490 | 9/1968 | Hettinger | 49/414 |
| 3,482,354 | 12/1969 | Trout | 49/181 |
| 3,611,636 | 10/1971 | Trout | 49/181 |
| 3,789,549 | 2/1974 | Yip | 49/181 |
| 3,797,168 | 3/1974 | Trout | 49/181 |
| 4,068,406 | 1/1978 | Wood | 49/181 |
| 4,079,549 | 3/1978 | Wood | 49/181 |
| 4,271,631 | 6/1981 | Trout | 49/181 |
| 4,363,190 | 12/1982 | Anderson | 49/181 |
| 4,364,199 | 12/1982 | Johnson et al. | 49/181 |
| 4,452,012 | 6/1984 | Deal | 49/181 |
| 4,540,070 | 9/1985 | Yonovich et al. | 188/380 |
| 4,610,108 | 9/1986 | Marshik | 49/181 |
| 4,718,194 | 1/1988 | Fitzgibbon et al. | 49/181 |

*Primary Examiner*—Gary L. Smith
*Assistant Examiner*—Jerry Redman
*Attorney, Agent, or Firm*—Merchant, Gould, Smith, Edell, Welter & Schmidt

[57] ABSTRACT

Disclosed is a sound silenced window frame jamb liner sash guide pocket. A layer of resilient material is coextruded with the material of the jamb liner to provide reverberation dampening of a window sash spring balance located within the jamb liner sash guide pocket.

7 Claims, 4 Drawing Sheets

FIG. 5
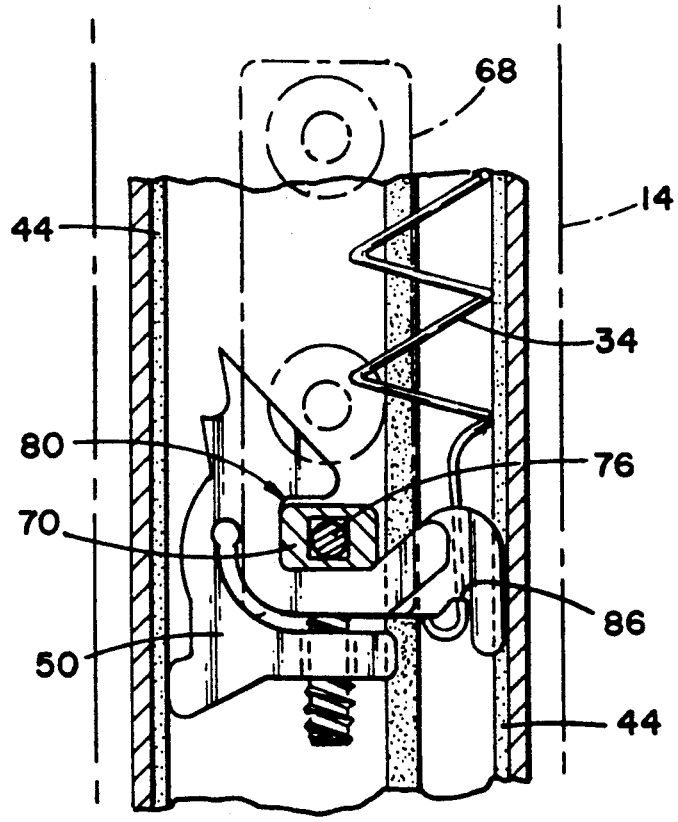
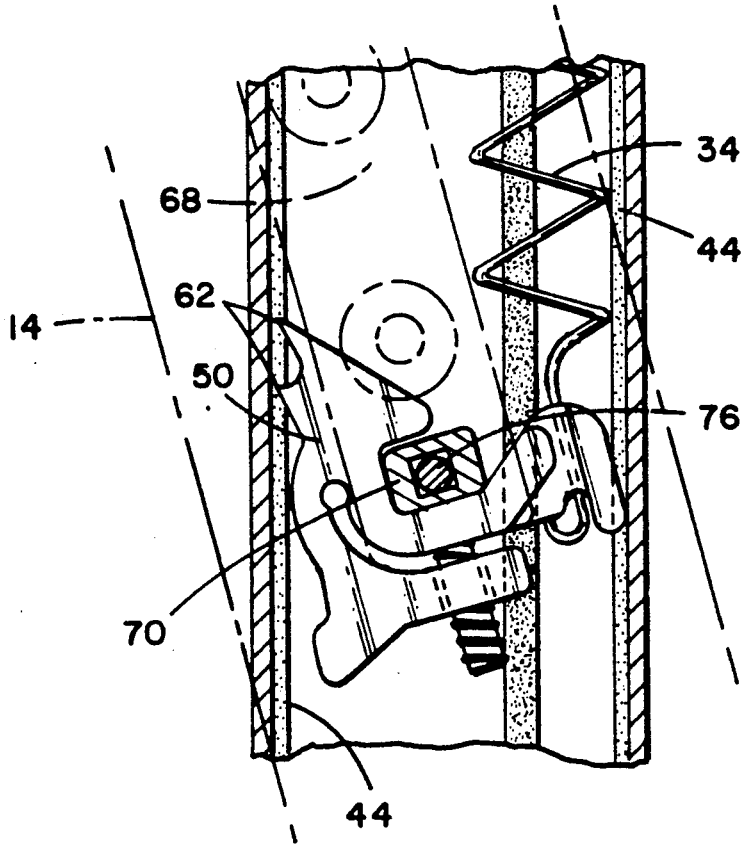
FIG. 4

FIG. 10
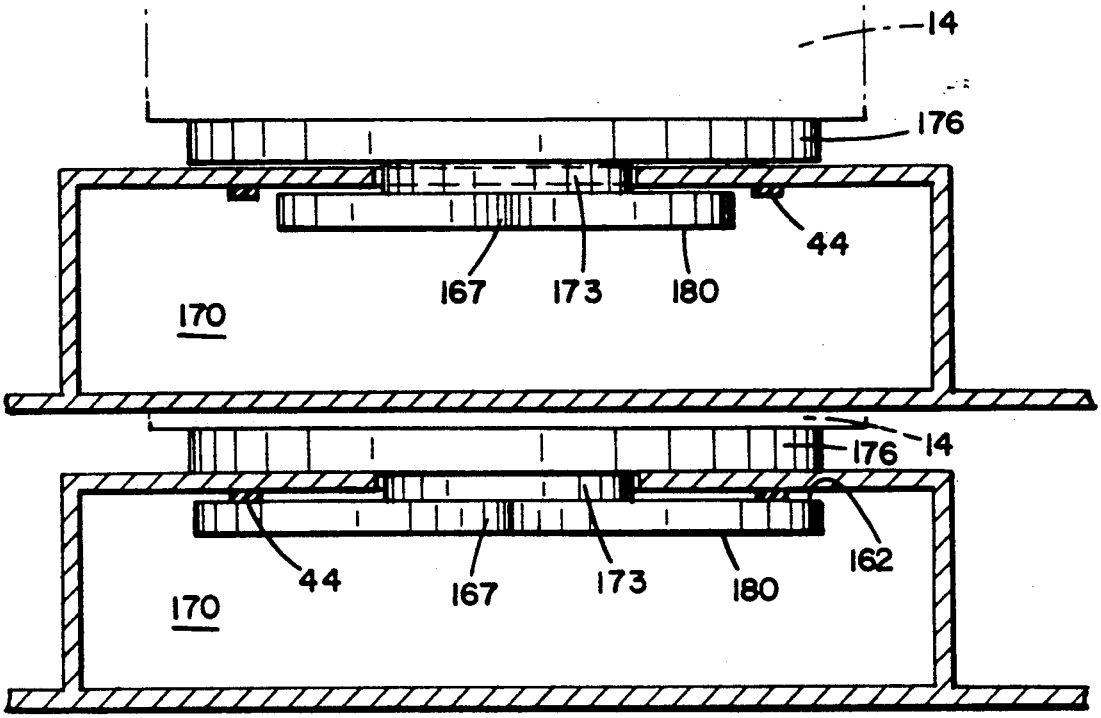
FIG. 11
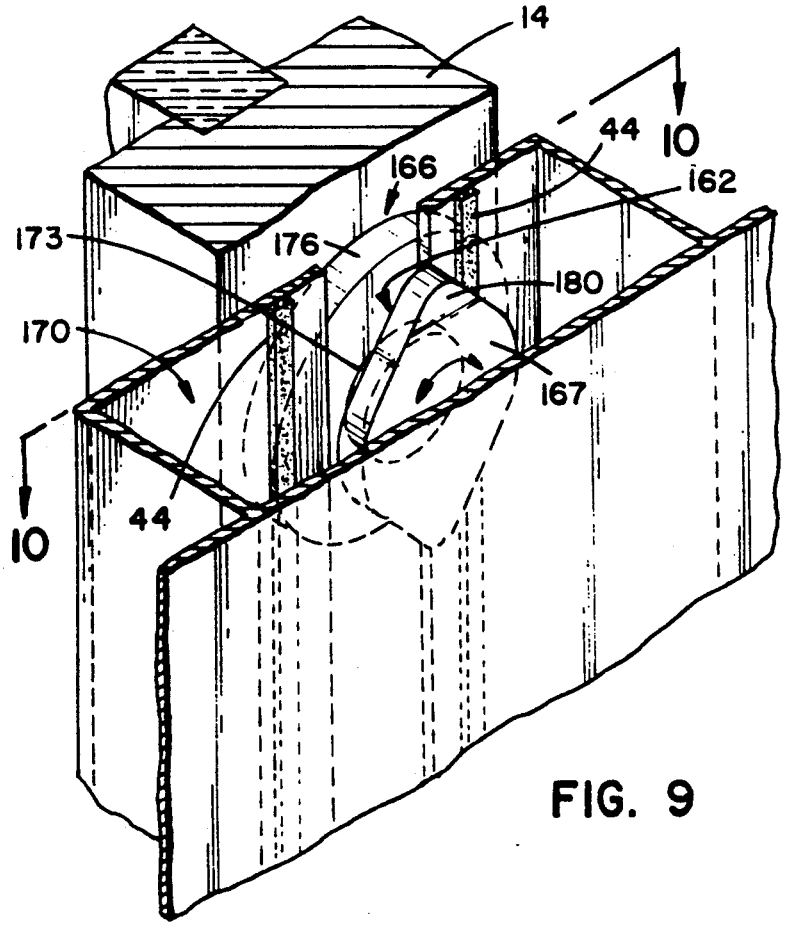
FIG. 9

SOUND SILENCED WINDOW FRAME JAMB LINER SASH GUIDE POCKET

TECHNICAL FIELD OF THE INVENTION

The present invention relates generally to a silencer for spring balances used with window sashes and more particularly to a sound silenced window frame jamb liner sash guide pocket having a layer of resilient material for dampening reverberation of a window sash spring balance.

SUMMARY OF THE INVENTION

A structure is provided which comprises a sound silenced window frame jamb liner sash guide pocket having inner surfaces for guiding a spring balanced window sash along an axis of a jamb liner. A layer of resilient material is attached to portions of the jamb liner sash guide pocket inner surfaces for providing sound silencing surfaces against which the window sash spring balance may contact. This contact permits window sash operation substantially independent of any spring balance reverberation sound being transmitted external of the jamb liner sash guide pocket.

BACKGROUND OF THE INVENTION

Within the field of window frame manufacture, numerous sizing requirements exist. Indeed, it is virtually impossible to create a universal window frame suitable for all sizing applications. Accordingly, substantial variations in window sizes require window frame jamb liner and window sash systems capable of adjustable use in variously sized frames. This requirement for adjustability combines with existing non-linearity of balancing means commonly used with spring balanced vertically hung window sashes and presents many challenges to achievement of smooth and efficient operation of window sashes. In particular, it is quite important to provide locking means for window sashes which are tiltable away from the vertical axis of related jamb liners. The locking means prevents inadvertent movement of a portion of the window sash due to unexpected contraction or operation of a spring balance connected thereto. Heretofore, locking systems comprising locking means have typically been complex arrangements of parts. These systems also typically result in considerable wear and tear of either the jamb liner or the window sash. Further, such systems typically do not provide means for vibration dampening of associated spring balances. However, even in those systems which provide spring balance vibration dampeners, such dampeners typically comprise complex structure or structure requiring substantial surface area in order to be effective.

What has been needed therefore has been a window tilt clutch system for use with a tiltable window sash which is slidably mounted in a window frame jamb liner comprising effective and non-destructive braking means for preventing undesired vertical movement of a window sash within a jamb liner.

What is further needed is a window tilt clutch system for use with a tiltable window sash slidably mounted in a window frame jamb liner comprising a window tilt clutch of integral construction requiring only simple manufacturing processes.

What has been even further needed has been a window tilt clutch system for use with a tiltable window sash slidably mounted in a window frame jamb liner comprising a window tilt clutch of simple construction that provides means for engaging a high friction resilient material when the window sash is tilted away from the vertical axis of the jamb liner and which comprises a hinged friction regulating section for adjustably engaging an inner-facing surface of a window frame jamb liner sash guide pocket during normal vertically oriented operation of a window sash.

What has also been needed has been a sound silenced window frame jamb liner sash guide pocket of simple construction comprising a layer of resilient material attached to portions of the jamb liner sash guide pocket inner surfaces for providing sound silencing surfaces against which a window sash spring balance may contact substantially independent of any reverberation sound being transmitted external of the jamb liner sash guide pocket.

Other objects and advantages of the invention will appear from the following detailed description which, in connection with the accompanying drawings, discloses embodiments of the invention for purposes of illustration only and not for determination of the limits of the invention.

BRIEF DESCRIPTION OF THE DRAWINGS

FIG. 4 is a side sectional elevation view of a clutch member and window sash partially tilted away from the jamb liner sash guide pocket taken generally along lines 4—4 of FIG. 2.

FIG. 5 is a side sectional view of a clutch member and window sash cooperating with a spring balance in normal vertically oriented operation within a window frame jamb liner sash guide pocket.

FIG. 9 is a perspective view of a window tilt clutch system in which the engaging surface means is shown comprising a locking cam mechanism in a normal unlocked position permitting vertically oriented movement of the attached window sash.

FIG. 10 is a top view of the engaging surface means locking cam mechanism taken generally along lines 10—10 of FIG. 9.

FIG. 11 is a top view of the engaging surface means locking cam mechanism generally analogous to that shown in FIG. 10 but illustrated in the rotated and locked position.

DETAILED DESCRIPTION OF THE INVENTION

As required, detailed embodiments of the present invention are disclosed herein. It is to be understood, however, that the disclosed embodiments are merely exemplary of the invention which may be embodied in various forms. Therefore, specific structural and functional details disclosed herein are not to be interpreted as limiting, but rather as a basis for teaching one skilled in the art to variously employ the present invention in virtually any appropriately detailed system or structure.

Figure 1:
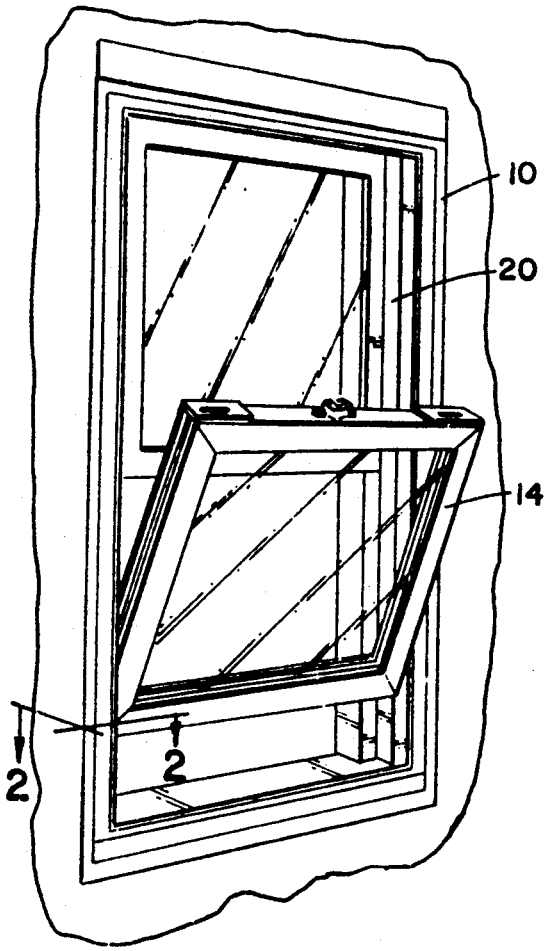
FIG. 1 is a front elevation environmental view of a window frame with vertically oriented double hung window sashes within a jamb liner with the lower sash partially tilted away from the jamb liner vertical axis.

Referring to FIG. 1, a representative window frame 10 is illustrated comprising a double hung sash arrangement. It is understood that throughout this discussion any reference to double hung window frame 10 may also generally comprise and incorporate the inventions herein as applied to a single hung window frame as well. FIG. 1 illustrates a pair of window sashes 14 in which the upper sash is shown in substantially vertical alignment with the vertical axis of window frame jamb liner 20. The lower window sash of FIG. 1 is illustrated in a position tilted away from the vertical axis of jamb liner 20. This tilting is frequently desirable for cleaning, maintenance, and repair of window sashes 14 and associated components.

Figure 2:
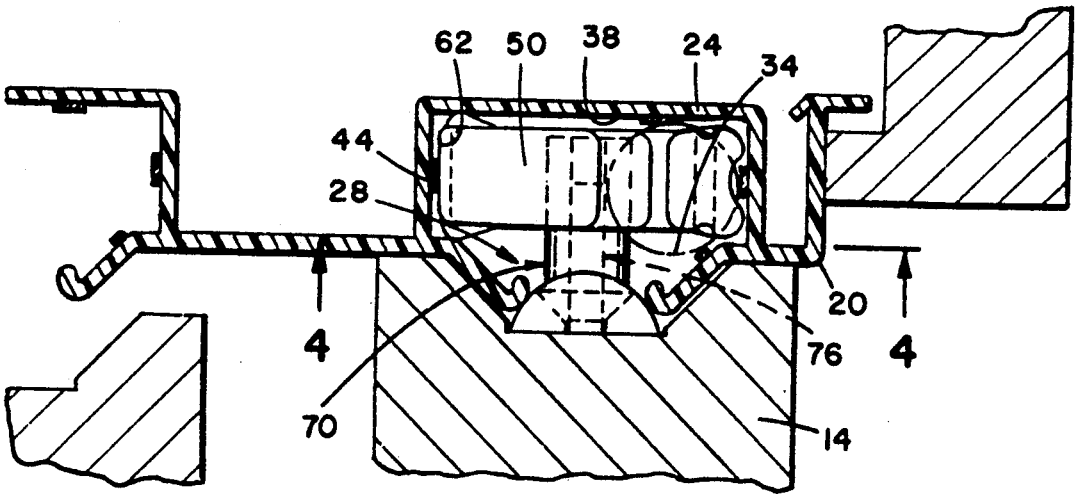
FIG. 2 illustrates a top section view of the jamb liner and the jamb liner sash guide pocket taken generally along lines 2—2 of FIG. 1.

Within the field of window frame manufacture, there is a variety of window frame designs and sizing requirements. Accordingly, jamb liner 20 may comprise a variety of shapes and sizes of jamb liners with various cross section configurations. The top sectional view of window frame 10 and jamb liner 20 in cooperation with window sash 14 illustrated in FIG. 2 is representative of a variety of possible jamb liner 20 configurations contemplated by the present inventions. Thus, it is recognized that representative jamb liner 20 contemplates a variety of shapes and sizes within the scope and spirit of the present inventions.

Referring to FIG. 2, window frame jamb liner 20 is shown comprising walls 24 arranged to form a sash guide pocket 28 within which various components are located for balancing and locking window sash 14. For example, referring to FIG. 2, FIG. 4, and FIG. 5, balancing means is shown comprising spring balance 34 for balancing window sash 14 within jamb liner 20. Although various balancing means are contemplated and used within the field of window frame construction, a common problem exists from reverberation of balancing means against portions of accompanying jamb liners, such as jamb liner 20. Various complex structures have been provided by prior manufacturers of window assemblies in an attempt to dampen or sound silence balancing means during operation. Heretofore, such efforts have resulted in complex structures requiring substantial additional manufacturing steps and labor costs which, in a competitive cost environment, are undesirable.

In order to overcome the significant drawbacks of prior efforts to effectively and simply dampen the vibrations of balancing means in window frame jamb liners, a sound silenced window frame jamb liner sash guide pocket 28 is provided as illustrated in FIG. 2, FIG. 4, and FIG. 5. In particular, a sound silenced window frame jamb liner sash guide pocket as shown comprises inner surfaces 38 of walls 24. Inner surfaces 38 are preferably arranged for guiding a spring balanced window sash 14 along a vertical axis of jamb liner 20. A layer of resilient material 44 is attached to portions of jamb liner sash guide pocket inner surfaces 38 for providing sound silencing surfaces against which window sash spring balance 34 may contact substantially independent of any reverberation sound being transmitted external of jamb liner sash guide pocket 28. As further disclosed herein, resilient material 44 may comprise high friction resilient material to achieve manufacturing efficiencies when resilient material 44 is used for purposes in addition to sound silencing. Thus, use of high friction resilient material 44 is preferred but not necessarily required to achieve the advantages of reverberation dampening as described herein. As illustrated in FIG. 2, FIG. 4, and FIG. 5, a preferred arrangement of resilient material 44 comprises at least one elongate strip placed along a portion of at least one inner surface 38 where balancing means are most likely to contact the inner surface. As shown in FIG. 2, a plurality of strips of resilient material 44 are arranged substantially vertically along the length of inner surfaces 38 of jamb liner walls 24 where spring balance 34 is most likely to contact jamb liner 20 inner surfaces 38. This arrangement of resilient material 44 provides an exemplary arrangement of sound silencing material relative to prior structure. A preferred resilient material 44 is constructed of plastic material. An even more preferable resilient material 44 comprises plastic material which is constructed of material selected from the group consisting of flexible polyvinylchloride and polyurethane.

It is also preferable that sound silenced window frame jamb liner 20 sash guide pocket 28 comprises inner surfaces 38 with portions thereof covered by resilient material 44 comprising extruded resilient material 44. For example, substantial manufacturing efficiencies result when extruded resilient material 44 is coextruded with an extruded window frame jamb liner such as jamb liner 20. This manufacturing efficiency eliminates numerous and excessive prior art components normally used in the manufacture of sound dampening systems for window sash balances. Also, the use of resilient material 44 in strip form as illustrated in FIG. 2, FIG. 4, and FIG. 5 substantially reduces the surface area of sound dampening means used in association with balancing means and therefore allows for use in more constricted jamb liner sash guide pockets as desired. Further, this configuration of resilient material 44 permits of great ease of construction through coextrusion techniques. This compares favorably to other known methods of applying vibration dampening structure to balancing means, such as flocked spring balances and the like. Overall, the construction and arrangement of a sound silenced window frame jamb liner sash guide pocket 28 with resilient material 44 attached to portions of inner surfaces 38 along substantially the entire length of movement of an associated window sash spring balance 34 provides ease of use and manufacture, and excellent cost effectiveness.

Within the field of window frame design and manufacture, there exists yet another need to provide improved locking means to permit window sashes to tilt away from a vertical axis of an associated jamb liner as illustrated in FIG. 1. Many previous locking means comprise very complex structure which often gouged, cut, or otherwise deformed portions of the jamb liner or related window frame assembly. By comparison, the present window tilt clutch system illustrated in FIG. 2, is useful with a tiltable window sash 14 slidably mounted in a window frame jamb liner 20 to provide simple, durable, and readily manufactured means for locking a sash in place. More particularly, the window tilt clutch system invention comprises window tilt clutch locking means preferably comprising a window tilt clutch member 50 operably connected to tiltable window sash 14 and slidably mounted within inner-facing surfaces 38 of window frame jamb liner sash guide pocket 28. Window tilt clutch member 50 is arranged in sash guide pocket 28 for locking window sash 14 in place at a position along the vertical axis of jamb liner 20 when window sash 14 is tilted away from the vertical axis of jamb liner 20. Also, a layer of high friction resilient material 44 is attached to portions of jamb liner 20 sash guide pocket inner surfaces 38 facing the locking means or, as illustrated in FIG. 2, the window tilt clutch member 50. High friction resilient material 44 is preferably constructed and arranged for providing a braking surface to prevent vertical movement of window sash 14 when the sash is tilted away from the vertical axis of jamb liner 20 and when high friction resilient material 44 is contacted by the locking means. Preferred high friction resilient material 44 may comprise material with substantially similar qualities and construction as described herein above but which comprises outer contact surfaces with a higher coefficient of friction than the surrounding jamb liner inner surfaces 38. Indeed, with regard to this particular use of high friction resilient material 44, a plastic material is preferably provided and constructed of materials selected from the group consisting of flexible polyvinylchloride and polyurethane. It is to be understood that other materials exhibiting substantially similar characteristics as will be further described may also be desirable and within the scope of this window tilt clutch system invention. Manufacture of high friction resilient material 44 in a process of coextrusion with an extruded window frame jamb liner 20 provides exemplary structure as illustrated in FIG. 2 for simply and effectively providing vibration dampening to spring balance 34 while simultaneously providing a braking surface at other locations within sash guide pocket 28 for window tilt clutch locking means engagement. Although other means of attaching high friction resilient material 44 to sash guide pocket inner surfaces 38 may be utilized, for example glue or other adhesive, substantial manufacturing efficiencies accrue from utilization of a coextrusion production process. High friction resilient material 44 preferably comprises material having a coefficient of friction which is greater than the coefficient of friction of the material comprising jamb liner sash guide pocket 28 inner surfaces 38. This configuration permits high friction resilient material 44 to function as a braking surface to prevent vertical movement of window sash 14 when the sash is tilted away from the vertical axis of jamb liner 20 causing high friction resilient material 44 to be contacted by the locking means. This further accomplishes the sash locking function in a non-destructive manner relative to jamb liner 20 inner surfaces 38.

Figure 3:
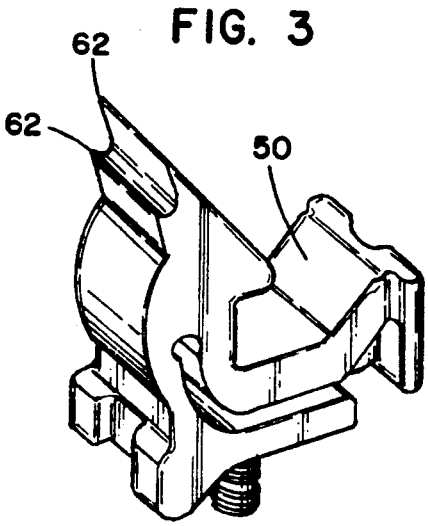
FIG. 3 is a perspective view of a clutch member for use in a window tilt clutch system.

FIG. 3 is a perspective illustration of a window tilt clutch member 50. Window tilt clutch member 50 is preferably of construction suitable for a window tilt clutch locking means required for use in the window tilt clutch system illustrated in FIG. 2. In particular, preferred locking means is constructed of high strength material selected from the group consisting of die cast metal, polycarbonate, glass filled nylon, and acetel. Window tilt clutch member 50 is representative of a desired window tilt clutch locking means comprising an integral and durable construction requiring only simple manufacturing and installation methods. Engaging surface means 62, illustrated in FIG. 3, provides for engaging high friction resilient material 44 when window sash 14 is tilted away from the vertical axis of jamb liner 20. Preferred engaging surface means 62 may comprise at least one barbed surface or it may comprise a serrated surface. Other engaging surface means 62 are provided and discussed later herein.

FIG. 4 is a side sectional illustration of a tilted window sash 14 comprising a portion of a window tilt clutch system corresponding generally to the view illustrated by lines 4—4 in FIG. 2. In particular, FIG. 4 illustrates sash 14 having a sash pin 68. Sash pin 68 is generally accompanied by at least one other sash pin per window sash 14. Each sash pin 68 comprises means for operably connecting balancing means to a window sash while also maintaining the locking means in a normally non-locked position. A portion of sash pin 68 comprising connecting means 70 is also provided and illustrated in FIGS. 4 and 5. Connecting means 70 thus preferably comprises a diecast connecting means to provide improved manufacturing efficiency of the entire sash pin. A connecting pin 76 is located within connecting means 70 to provide secure attachment of connecting means 70 and therefore sash pin 68 with window sash 14. As best illustrated in FIG. 2, the construction of connecting means 70 extends normal or substantially normal to window sash 14 into jamb liner sash guide pocket 28 and into the locking means. In particular, connecting means 70 extends into sash guide pocket 28 for insertion into window tilt clutch member 50 connecting means mounting portion 80. In the embodiment illustrated in FIG. 2, FIG. 4, and FIG. 5, this provides ease of assembly while at the same time providing means for engaging surface means 62 to be rotated into contact with high friction resilient material 44 as window sash 14 tilts away from the vertical axis of jamb liner 20. In other words, as window sash 14 tilts away from the vertical axis of jamb liner 20, sash pin 68 and connecting means 70 rotate as well. This rotation or tilt away from the vertical axis of jamb liner 20 imparts corresponding rotation to connecting means mounting portion 80 of the locking means. This rotates the locking means so that engaging surface means contact and lockingly engage high friction resilient material 44 to prevent movement of window sash 14 in a vertical direction. FIG. 4 illustrates this configuration wherein engaging surface means 62 comprises a plurality of surfaces shaped as a serrated surface located in engaging relationship with high friction resilient material 44. By comparison, FIG. 5 illustrates window sash 14 reoriented to a normal vertically oriented position relative to the vertical axis of jamb liner 20. In the orientation shown in FIG. 5, window sash 14 is free to move in a vertical position with locking means also moving along with window sash 14 in sash guide pocket 28 without any contact between engaging surface means 62 and high friction resilient material 44. As shown, attachment means 86 is provided for attaching the associated window sash balance mechanism, such as spring balance 34, to the locking means. FIG. 4 and FIG. 5 illustrate spring balance 34 directly connected to attachment means 86. However, it is understood that spring balance 34 or other balancing means may be operably connected to attachment means 86 in non-direct connection, such as by an extension string or the like.

Figure 6:
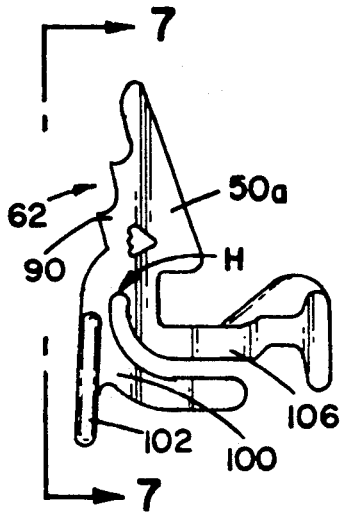
FIG. 6 is a side elevation view of a clutch member for use in a window tilt clutch system.

Referring now to FIG. 6, yet another embodiment of a preferred locking means is shown. Actually, FIG. 6 illustrates modified window tilt clutch member 50*a* wherein engaging surface means 62 preferably comprises at least three barbed or serrated engaging surfaces 90 constructed and arranged for engagement with high friction resilient material 44. FIG. 6 also illustrates in side elevation view, a locking means comprising an adjustable locking means for adjusting the amount of residual friction between the locking means and inner surfaces 38 of window frame jamb liner sash guide pocket 28 during normal unlocked movement of tiltable window sash 14 within a window frame. The adjustable locking means represented by modified window tilt clutch member 50*a* comprises a hinged friction regulating section 100 preferably comprising at least one friction regulating surface 102, and anchor section 106 which is hingably connected to hinged friction regulating section 100. When referring to a hinge within the present discussion, it is recognized from FIG. 6 and related figures that reference is to an open tension type hinge generally designated at the structure and location labelled H, but that other simple hinge constructions may be suitable within the spirit and scope of this invention.

Figure 7:
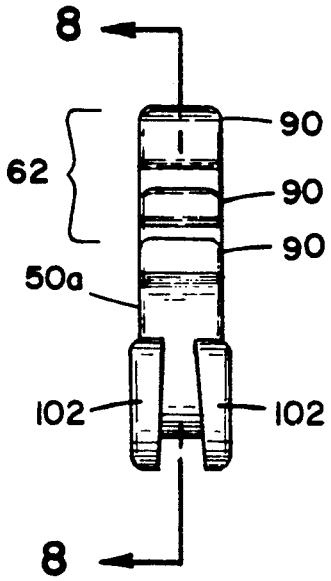
FIG. 7 is a front elevation view of a clutch member taken generally along lines 7—7 of FIG. 6.

FIG. 7 is a front elevation view corresponding generally to lines 7—7 of FIG. 6 to illustrate engaging surface means 62 and a plurality of friction regulating surfaces 102 which function as a form of normal mode brake shoes. FIG. 7 actually illustrates a pair of split finger friction regulating surfaces 102 constructed and arranged for adjustably contacting jamb liner sash guide pocket sidewall inner surfaces 38 to provide residual friction during normal operation of window sash 14 to overcome spring non-linearity. The arrangement of a split finger friction regulating surface permits frictional contact with inner surfaces 38 without contacting high friction resilient material 44. The efficient structures of both window tilt clutch member 50 and modified window tilt clutch member 50*a* permit such functional combination.

Figure 8:
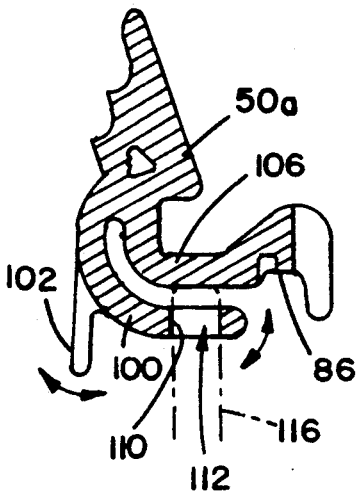
FIG. 8 is a side sectional elevation view of a clutch member taken generally along lines 8—8 of FIG. 7 and including phantom setscrew means extending through a portion of a hinged friction regulating section for adjustably moving the hinged friction regulating section relative to an anchor section.

Referring now to FIG. 8, a side section view of modified window tilt clutch member 50*a* is shown. In particular, hinged friction regulating section 100 comprises surfaces defining walls 110 shaped for providing a bore 112 through hinged friction regulating surface 100. A preferred configuration of bore 112 comprises a threaded bore so that optional setscrew means may be inserted therein. More particularly, setscrew means 116 (shown in phantom lines) is preferably extended through a portion of hinged friction regulating section 100 comprising bore 112 to abut against a portion of anchor section 106. This provides for adjustably moving hinged friction regulating section 100 relative to anchor section 106 whereby the residual friction of locking means hinged friction regulating section friction regulating surfaces 102 against inner surfaces 38 of window frame jamb liner sash guide pocket 28 is altered.

Referring again to FIG. 3 and FIG. 8, window tilt clutch member 50 and modified window tilt clutch member 50*a* are shown. Both of these members are integral to an improved window tilt clutch system for use with a tiltable window sash 14 slidably mounted in a window frame jamb liner 20 of the type in which an adjustable friction regulating surface contacts a component of the window frame jamb liner to regulate the rate of vertical movement of the window sash along jamb liner 20. An improvement provided by such a window tilt clutch system comprises a single piece clutch member, such as member 50 or 50*a*, comprising a hinged friction regulating section 100 having at least one friction regulating surface 102, and an anchor section 106 connected to hinged friction regulating section 100. The improvement further comprises setscrew means 116 extending through a portion of hinged friction regulating section 100 to abut against a portion of anchor section 106 for adjustably moving hinged friction regulating section 100 relative to anchor section 106 whereby the force of hinged friction regulating section at least one regulating surface 102 against a component of window frame jamb liner 20 is altered. A preferred setscrew means comprises a self-tapping hexagonal head setscrew.

FIG. 9 illustrates a window tilt clutch system in which the engaging surface means 162 comprises a locking cam mechanism 166. As illustrated in FIG. 9, locking cam mechanism 166 comprises a first portion 167 constructed and arranged for rotatable movement within window frame jamb liner sash guide pocket 170. A second portion 173 of locking cam mechanism 166 provides fixed operable connection between representative window sash 14 and first portion 167. FIG. 10 is a top view generally corresponding to lines 10—10 of FIG. 9 which illustrates locking cam mechanism third portion 176 which provides means for connecting locking cam mechanism first portion 167 with locking cam mechanism second portion 173.

As shown in FIG. 9 and FIG. 10, a preferred locking cam mechanism 166 comprises an elongate shaped locking cam 180. Elongate shaped locking cam 180 may also comprise a substantially elliptically shaped locking cam. The particular configuration shown in FIG. 9 and FIG. 10 of elongate shaped locking cam 180 permits travel of locking cam first portion 167 and locking cam mechanism second portion 173 within portions of sash guide pocket 170 without contacting high friction resilient material 44 during normal unlocked operation of window sash 14. However, as illustrated in FIG. 11, when it is desirable to tilt window sash 14 from a vertical axis or the axis which comprises the directional axis of normal unlocked travel of window sash 14 the particular function of locking cam mechanism 166 is disclosed. As shown in FIG. 11, elongate shaped locking cam 180 is coupled through other components of locking cam mechanism 166 so that rotation or tilting of window sash 14 imparts substantially identical rotation or tilting to elongate shaped locking cam 180 as well. This results in engaging surface means 162 being rotated into contact with high friction resilient material 44 which provides a locking phenomenon to prevent vertical movement of window sash 14.

Figure 12:
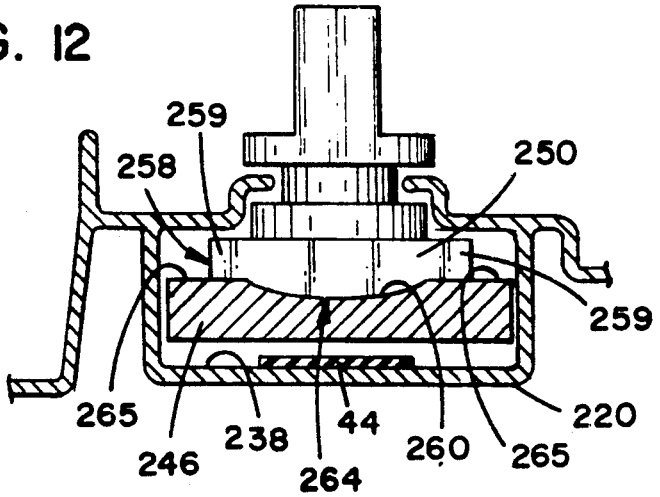
FIG. 12 is a top view of a window tilt clutch system in which the locking cam mechanism comprises a positive motion solid cylindrical cam mechanism shown in the unlocked position.
Figure 13:
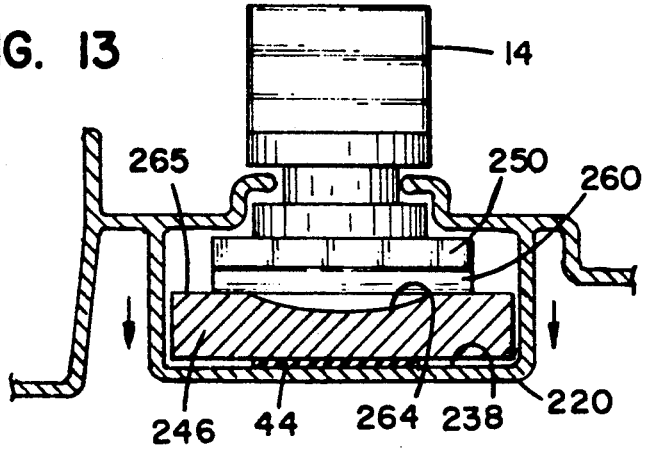
FIG. 13 illustrates a positive motion solid cylindrical cam mechanism corresponding generally to that shown in FIG. 12 but illustrated in a locked position.

FIG. 12 and FIG. 13 illustrate yet another embodiment of a locking cam mechanism for use with a window tilt clutch system. FIG. 12 illustrates a window frame jamb liner 220 comprising a section of resilient high friction material 44 located on at least one inner-facing surface 238 of window frame jamb liner 220. The locking cam mechanism preferably comprises a positive motion solid cylindrical cam mechanism comprising a cam follower member 246 normally biased in a position away from contact with high friction resilient material 44, and cam member 250. Cam member 250 preferably comprises a cam face 258 comprising cam face planar sections 259 and cam face arcuate section 260. Preferred cam face arcuate section 260 comprises a convex surface relative to cam face planar sections 259. Thus, cam face 258 is constructed and arranged for cooperation with cam follower member 246 in a cam profile as illustrated in FIG. 12. As shown in FIG. 12 and FIG. 13, cam follower member 246 comprises concave surface 264 and cam follower member planar surfaces 265. When cam member 250 is rotated by movement of window sash 14 to a tilted position, cam face arcuate section 260 rotates as well. As cam member 250 rotates, the conformal relationship between cam face arcuate section 260 and cam follower member concave surface 264 is altered. As shown in FIG. 13, the rotation of cam member 250 results in cam face arcuate section 260 being the only contact surface between cam member 250 and cam follower member 246. This contact results in movement of cam follower member 246 against high friction resilient material 44 to provide braking force preventing vertical movement of window sash 14. It is understood that in this embodiment and others the location of high friction resilient material 44 may be on movable components such as on cam follower member 246. The configuration would result in contact between high friction resilient material 44 and inner facing surfaces of a jamb liner sash guide pocket, such as surfaces 238. A positive motion solid cylindrical cam mechanism is thus disclosed in FIG. 12 and FIG. 13 for preventing vertical movement of window sash 14 when the sash is tilted away from the vertical axis of jamb liner 220.

What is provided, therefore, is a window tilt clutch system having several embodiments for use with a tiltable window sash slidably mounted in a window frame jamb liner. A preferred window tilt clutch system comprises a window tilt clutch adjustable locking means operably connected to a tiltable window sash and slidably mounted within inner-facing surfaces of a window frame jamb liner sash guide pocket. The window tilt clutch adjustable locking means provides means for locking the sash in place along a vertical axis of the jamb liner when the sash is tilted away from the vertical axis of the jamb liner. A preferred adjustable locking means comprises connecting means for operably connecting the adjustable locking means to a window sash; engaging surface means for engaging a high friction resilient material when the window sash is tilted away from the vertical axis of the jamb liner; a hinged friction regulating section comprising at least one friction regulating surface for adjustably engaging an inner-facing surface of a window frame jamb liner sash guide pocket; an anchor section hingably connected to the hinged friction regulating section; and setscrew means extending through a portion of the hinged friction regulating section and against a portion of the anchor section for adjustably moving the hinged friction regulating section relative to the anchor section whereby the force of the hinged friction regulating section against the inner-facing surface of the window frame jamb liner sash guide pocket is altered. The window tilt clutch system further comprises a layer of high friction resilient material located at portions of the jamb liner sash guide pocket inner surfaces facing the locking means. The layer of high friction resilient material is preferably constructed and arranged for providing a braking surface to prevent vertical movement of a window sash when the sash is tilted away from the vertical axis of the jamb liner so that the high friction resilient material is contacted by the locking means.

Alternately, a window tilt clutch system for use with a tiltable window sash slidably mounted in a window frame jamb liner may simply comprise a window tilt clutch locking means and a layer of high friction resilient material. The window tilt clutch locking means is operably connected to a tiltable window sash and slidably mounted within inner-facing surfaces of a window frame jamb liner sash guide pocket for locking the sash in place along a vertical axis of the jamb liner when the sash is tilted away from the vertical axis of the jamb liner. The layer of high friction resilient material is attached to portions of the jamb liner sash guide pocket inner surfaces facing the locking means and is constructed and arranged for providing a braking surface to prevent vertical movement of the window sash when the sash is tilted away from the vertical axis of the jamb liner and when the high friction resilient material is contacted by the locking means.

Although specific mechanical configurations have been illustrated and described for the preferred embodiments of the present invention set forth herein, it will be appreciated by those of ordinary skill in the art that other arrangements which are calculated to achieve the same purpose may be substituted for the specific configurations shown. Thus, while the present invention has been described in connection with the preferred embodiments thereof, it will be understood that many modifications will be readily apparent to those of ordinary skill in the art, and the disclosed configurations herein are intended to cover any adaptations or variations thereof. Therefore, it is manifestly intended that the inventive aspects described herein be limited only by the claims and the equivalents thereof. Accordingly, it is also understood that while certain embodiments of the present invention have been illustrated and described, the invention is not to be limited to the specific forms or arrangement of parts herein described and shown.

What is claimed is:

1. A sound silenced window frame jamb liner sash guide pocket comprising inner surfaces for guiding a spring balanced window sash along a vertical axis of a jamb liner, comprising:

a) a window frame jamb liner sash guide pocket comprising inner surfaces for guiding a spring balanced window sash along a vertical axis of the jamb liner; and b) a layer of resilient material attached to portions of the jamb liner sash guide pocket inner surfaces for providing sound silencing surfaces against which the window sash spring balance may contact substantially independent of any reverberation sound being transmitted external of the jamb liner sash guide pocket.

2. A sound silenced window frame jamb liner sash guide pocket according to claim 1 wherein the resilient material is constructed of plastic material.

3. A sound silenced window frame jamb liner sash guide pocket according to claim 2 wherein the resilient plastic material is constructed of material selected from the group consisting of flexible polyvinylchloride and polyurethane.

4. A sound silenced window frame jamb liner sash guide pocket according to claim 1 wherein the resilient material is constructed of extruded material.

5. A sound silenced window frame jamb liner sash guide pocket according to claim 4 wherein the extruded resilient material is coextruded with an extruded window frame jamb liner.

6. A sound silenced window frame jamb liner sash guide pocket according to claim 1 wherein the resilient material is attached to portions of the jamb liner sash guide pocket inner surfaces along substantially the entire length of movement of an associated window sash spring balance.

7. A sound silenced window frame jamb liner sash guide pocket according to claim 1 wherein the resilient material comprises high friction resilient material.

* * * * *